United States Patent [19]

Graf et al.

[11] Patent Number: 4,593,437

[45] Date of Patent: Jun. 10, 1986

[54] CARD FLATS SEGMENT

[75] Inventors: Ralph Graf, Freienbach; Werner Bisquolm, Siebnen, both of Switzerland

[73] Assignee: Graf & Cie. A.G., Rapperswill, Switzerland

[21] Appl. No.: 701,382

[22] Filed: Feb. 14, 1985

[30] Foreign Application Priority Data

Feb. 14, 1984 [CH] Switzerland ..... 716/84

[51] Int. Cl.[4] ..... D01G 15/24

[52] U.S. Cl. ..... 19/113; 19/114

[58] Field of Search ..... 19/111, 113, 114

[56] References Cited

U.S. PATENT DOCUMENTS

| | | | |
|---|---|---|---|
| 1,811,549 | 6/1931 | Langer | 19/114 X |
| 3,151,362 | 10/1964 | Freitag | 19/114 |
| 4,221,023 | 9/1980 | Henderson et al. | 19/113 |
| 4,297,768 | 11/1981 | Löffler | 19/114 X |
| 4,513,480 | 4/1985 | Bisquolm et al. | 19/114 X |
| 4,528,724 | 7/1985 | Bisquolm | 19/113 |

FOREIGN PATENT DOCUMENTS

| | | | |
|---|---|---|---|
| 2544291 | 4/1977 | Fed. Rep. of Germany . | |
| 0750191 | 4/1933 | France . | |
| 1112889 | 3/1956 | France . | |
| 0005884 | of 1889 | United Kingdom | 19/113 |
| 0294920 | 7/1928 | United Kingdom | 19/113 |
| 2100305 | 12/1982 | United Kingdom . | |

*Primary Examiner*—Louis K. Rimrodt

*Attorney, Agent, or Firm*—Ladas & Parry

[57] ABSTRACT

A plurality of supporting members for card clothing wires integrated in a frame and arranged directly adjacently succeeding each other in the direction of the carding forms a carding member which cooperates as revolving flat card together with a main drum. The card clothing of the individual supports can be exchanged individually and preferably a card clothing is used similar to the one of revolving flat arrangements. Accordingly the procedure when mounting and exchanging the card clothing of revolving flat cards can be simplified considerably.

11 Claims, 7 Drawing Figures

CARD FLATS SEGMENT

BACKGROUND OF THE INVENTION

1. Field of the Invention

The present invention relates to a card flats segment intended for a rigid mounting to a carding machine.

Carding machines are generally known to be available in three different design configurations, which configurations differ basically from each other regarding the machine parts which cooperate with the main drum of the carding machine. These machine parts can be designed in form of an unmovable, rigid flat card, of a revolving flat arrangement or of a worker roller pair. The revolving flat arrangements are applied mainly for the removal of contaminating matter and the revolving flat cards are applied mainly for a parallelizing of the fibres.

2. Description of the Prior Art

Generally, revolving flat cards comprise a plurality of cast iron bars forming flats which are interconnected by chains and guided accordingly along a predetermined angular area at the main drum. Each individual cast iron bar is provided with a card clothing which can easily be mounted and replaced such as disclosed, for instance, in the published European patent application No. 0 091 986. Due to the relative small dimensions of the cast iron bars seen in direction of carding the card clothing can also be designed in a flat configuration which facilitates their construction and design.

The application of card flats plates on carding machines lead to the difficulty that the card clothing extends along a considerably larger sector of the main drum and must be mounted to a curvilinearly extending inner surface of a flat plate which is bent corresponding to the radius of the main drum. Such as is disclosed in the DE-AS No. 20 02 639 a complicated method is necessary to this end, according to which method the card clothing wires must initially be wound onto an auxiliary drum in a state in which the tips of the teeth face inwards, whereafter the flat plates are located thereupon and the card clothing finally mounted to these plates. An exchange of such card clothing wires at their operational site appears not to be possible such that in every instance the card flats plates must be sent back to the manufacturer thereof. This is also true for designs disclosed, for instance, in the CH-PS No. 639 433. The manufacturer in turn must utilize in such cases specifically designed equipment which cannot be applied in case of revolving flats.

Furthermore, such known carding machines having unmovable or rigidly mounted, respectively, carding plates are bestowed the drawback that due to the above described method of manufacturing a given carding flat plate must be provided with identical card clothing throughout its extent such that no graduation regarding fineness and setting is possible.

The GB-A No. 2 100 305 discloses a card flats segment including a plurality of rows of card clothing arranged consecutively relative to the direction of carding. These are, however, rigidly mounted on a common carrier and within guide elements machined therein and, therefore, cannot be individually exchanged at the work site nor be individually adjusted for an individual positioning; such procedures necessitate in fact an exchanging of the entire carrier.

The FR-A No. 750 191 discloses a carding machine having concavely shaped flats and a plurality of rows of card clothing is mounted to each flat. Because the mounting means thereof are located between the individual rows, large interstices in the direction of carding exist leading to a detrimental reduction of the carding effect. Furthermore, also this design does not allow an independent exchanging of individual card clothing rows and necessitate a returning of the entire carding flat to the respective manufacturer.

The same drawbacks exist in the designs in accordance with the disclosure of the DE-A No. 2 544 291 and of the FR-A No. 1 112 889.

SUMMARY OF THE INVENTION

Hence, due to the above described conditions it is the object of the invention to provide a card flats segment intended for a rigid mounting to a carding machine which does not incorporate above explained drawbacks, i.e. which can easily be serviced and easily be adjusted without the necessity of a return thereof to the manufacturer for carrying out such task and which, furthermore is in the position to receive graduated card clothing which can easily be adjusted for specific demands.

A further object of the invention is to provide a card flats segment having a plurality of supporting members integrated in a frame, which supporting members are arranged directly adjacently succeeding each other in the direction of the carding and extend at least across the width of the card, each supporting member being designed for a releasable receipt of sawtooth card clothing wires forming the card clothing and lined up thereupon across mentioned width of the card.

This allows now the card clothing and their mounting a the flat to be designed corresponding to such of revolving flats whereby all auxiliary machines and devices necessary for a replacement and mounting can be utilized simultaneously for both applications. Furthermore, it is possible to have variation of the card clothing between the individual supporting members of a card flats segment.

Preferably, the supporting members are designed to receive card clothing wires used in revolving flats, to which end in the simplest case they are formed directly by bars of the revolving flat design.

This leads to a further simplification of the structure of carding devices in the sense that the elements are exchangeable.

Preferably, the entire frame or at least parts thereof are made of extruded aluminium profile, which on the one hand does away with a secondary machining or handling, respectively, during manufacture and, on the other hand leads to card flats segments having a relatively low weight allowing their mounting and dismounting to be done manually.

BRIEF DESCRIPTION OF THE DRAWINGS

The present invention will be more fully understood and objects, other than those set forth above, will become apparent when consideration is given to the following detailed description thereof, when read in conjunction with the appended drawings, and wherein.

DESCRIPTION OF THE PREFERRED EMBODIMENTS

Figure 1:
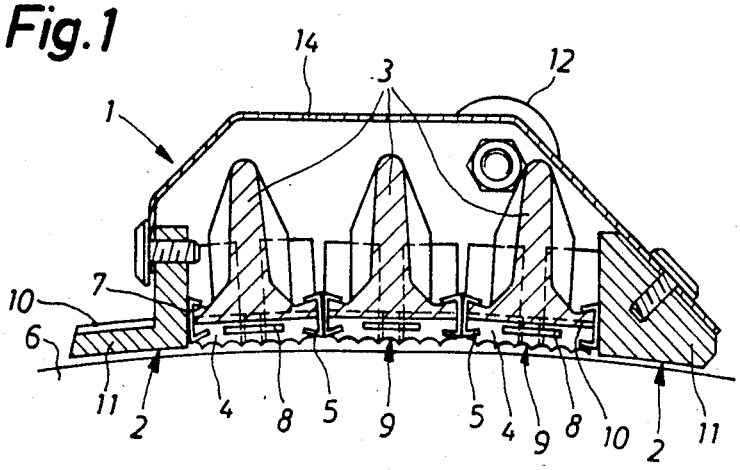
FIG. 1 is a sectional view of a card flats segment set together by bars of revolving flats.

Prior to entering in detail into the individual embodiments of the invention the principles on which the invention is based will be explained in conjunction with the illustrations of FIGS. 1 and 2.

The card flats segment 1 comprises a frame 2, within which a plurality of supporting members 3 is integrated, onto which the card clothing in form of sawtooth card clothing wires 4 lined up upon a support 8 are mounted by means of clips 5. Seen in the direction of carding the supporting members 3 are arranged directly adjacently succeeding each other such that only small gaps are present between the individual card clothing leading to a substantially uninterrupted working area. To this end also the card clothing extends substantially across the total extent of the respective supporting members seen in the direction of carding. If now a flat card clothing consisting of linearly extending sawtooth wires is used such as described in the various embodiments, this working area consists of a series of tangential planes of the main drum 6. Each tangential plane comprises, therefore, geometrically a line contact at the circumference of the main drum 6 and the location of this contact line relative to the card clothing can be chosen for any supporting member independently of the other supporting members. In practice, this contact line is oriented at a location rather remote from the entrance area at least at the seen in the direction of carrying first supporting member which corresponds to a certain angle of pitch. The individual adjustment can be arrived at by a corresponding design of the supporting surfaces for supporting the supporting members on frame 2 or then by a corresponding dimensioning of the supporting members themselves.

The frame 2 and the supporting members 3 are designed furthermore such that the card clothing 4 can be exchanged individually. To this end a generally known clamping connection by means of clips is applied such as illustrated in the figures, which mounting particularity is generally used in revolving flat arrangements. The clips 5 extend across the width of the carding machine and are anchored at corresponding surface areas 7 of the supporting members 3. Preferably now, the supporting members 3 are shaped at the corresponding areas such as is the case in existing revolving flats such that both can receive the same sawtooth card clothing wires as well as the same clips which conclusively can be mounted or dismounted, respectively, by means of identical auxiliary equipment.

The frame 2, into which the supporting members are integrated, is constructed of profiles which are resistant to bending and at least those profiles extending across the width of the carding machine are made of extruded aluminium profiles such as will be explained more in detail further below.

Figure 2:
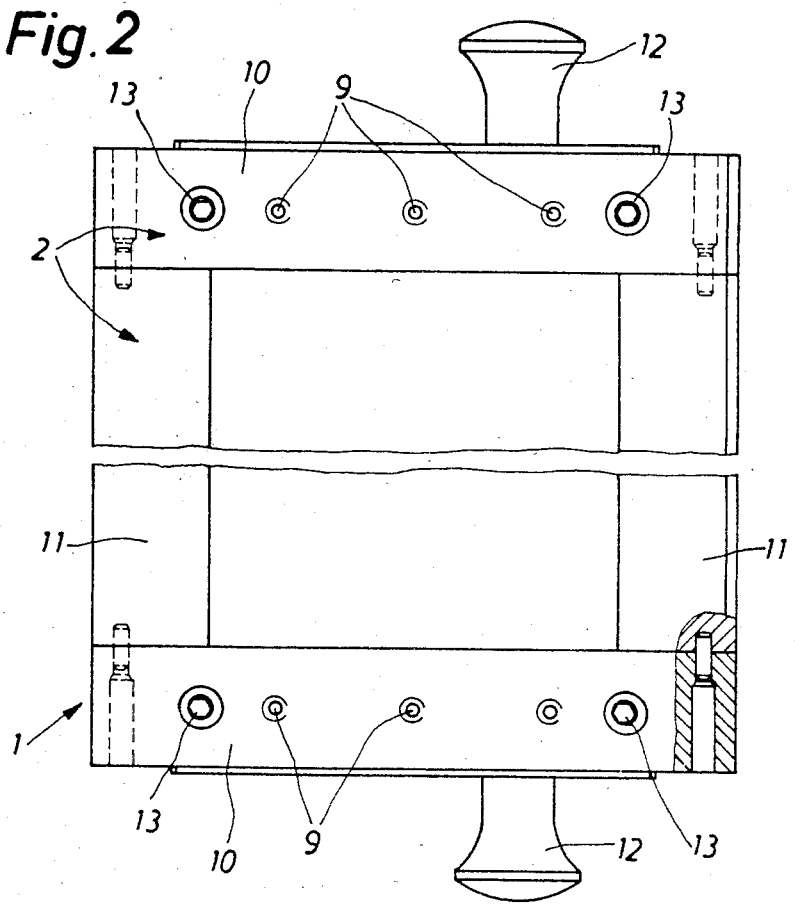
FIG. 2 is a top view of the card flats segment illustrated in FIG. 1.

The design illustrated in FIGS. 1 and 2 incorporates the speciality that the cast iron flat bars of a revolving flat carding machine are utilized as supporting members 3. These bars are bolted by means of screw bolts at the positions 9 each to longitudinal struts 10 of the frame 2, which struts 10 are shaped to correspond to the circumferential shape of the main drum 6 and are manufactured of steel. The traverse struts 11 of the frame consist of aluminium profiles which also are resistant to bending, which profiles are screw bolted at the corners to the longitudinal struts. Because the length of the traverse struts (e.g. between about 4 and 5 feet) exceeds considerably the length of the longitudinal struts (in the present embodiment less than $\frac{3}{4}$ inch), the savings on weight of the frame is considerable such that a mounting or dismounting, respectively, of the card flats segment 1 can be carried out manually.

To this end, laterally located handles 12 are provided, which are mounted to the side walls. Therefore, the card flats segment 1 is releasably mounted to the edges of the machine main frame by means of screw bolt mountings 12. A removable sheet metal hood 14 prevents egress of dust.

An exchange or replacing, respectively, of the card clothing can be carried out separately at each supporting member 3. To this end, such supporting member is dismounted from frame 2, thereafter the clips 5 are opened according to known procedures and the card clothing wire strips lined up upon the support 8 can be exchanged in their entirety.

The adjustment of the position of the individual card clothing relative to the main drum 6 can be achieved by means of a corresponding machining of the surfaces of the supporting members 3 supporting such against frame 2.

Figure 3:
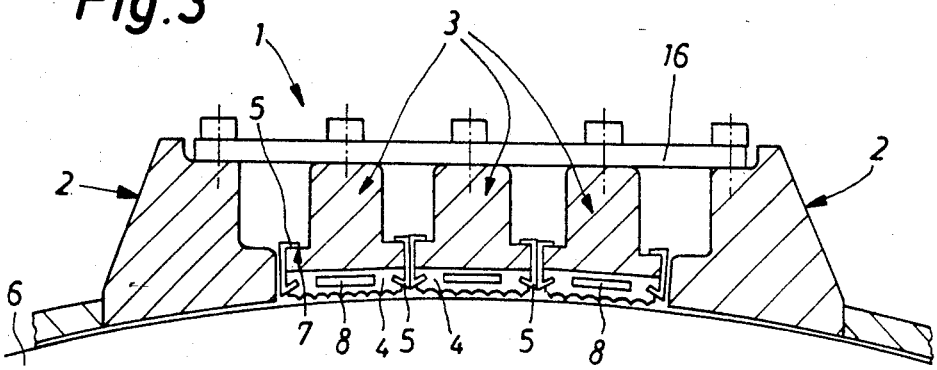
FIG. 3 is a sectional view of a card flats segment having a frame which is designed integrally with the supporting members.
Figure 4:
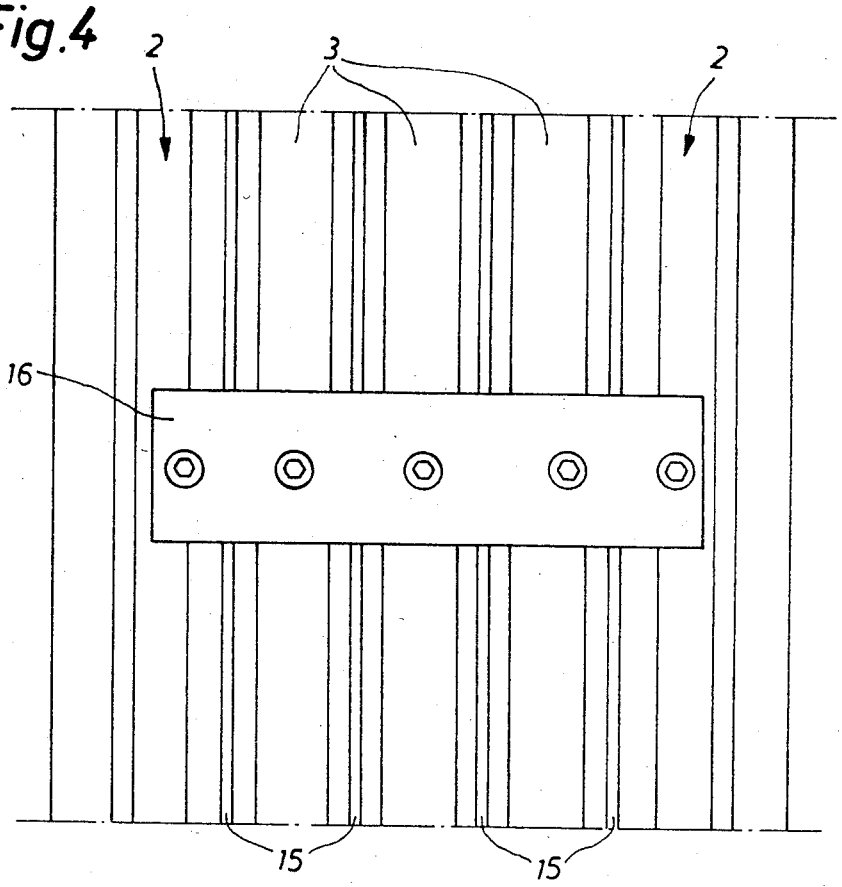
FIG. 4 is a plan view of a part of the card flats segment illustrated in FIG. 3.

A further embodiment of the invention is illustrated in FIGS. 3 and 4, according to which embodiment the supporting members 3 are shaped integrally with the frame 2 made of aluminium profile. Because here, contrary to the first embodiment the supporting members themselves are also made of aluminium, a further savings on weight can be achieved. The individual supporting members 3 are defined by slots 15 machined into the aluminium profile. These slots 15 receive the clips 5 of the card clothing. The dismounting of these clips for a replacing of the card clothing proceeds from the upper side of the segment such that the slots 15 are accessible from above. For stiffening of the segment cross bars 16 located at the mutual distance of about 1 foot can be releasably mounted onto the supporting members 3.

The adjusting of the position of the card clothing relative to the main drum proceeds by a corresponding setting of the lower surfaces of the supporting members 3. This may be made directly during the extrusion of the aluminium profile such that a following machining is not necessary.

The production of this segment proceeds such as described by extruding a corresponding aluminium profile. After the extruding process slots 15 are milled into this profile and the various screw holes drilled therein. A further machining or handling is not necessary.

Figure 5:
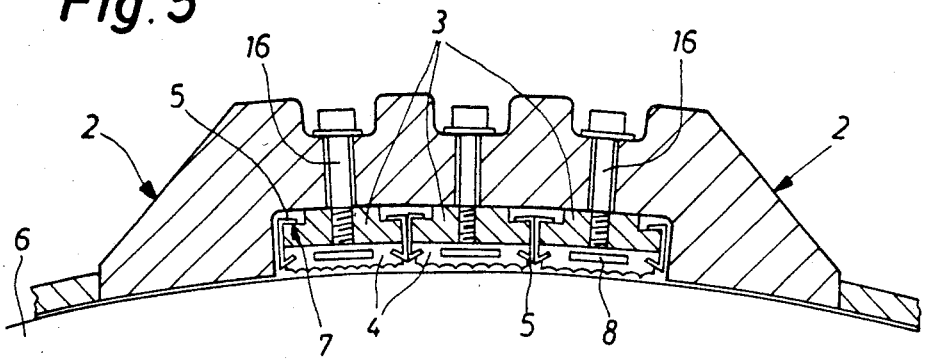
FIG. 5 is a sectional view of a card flats segment having a hood shaped frame.
Figure 6:
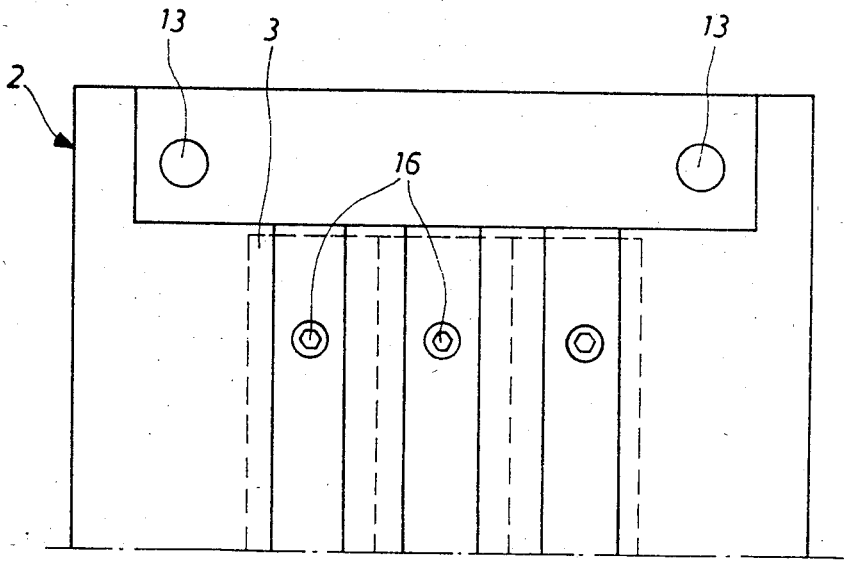
FIG. 6 is a top view of an edge area of the card flats segment illustrated in FIG. 5.

A third embodiment of the invention is illustrated in FIGS. 5 and 6, in which embodiment the frame 2 has a flat-like configuration. The supporting members 3 are present in shape of bars or ledges which are releasably mounted to the frame 2 by means of screw bolts 16. This frame is shaped as extruded aluminium profile such as is the case in the preceding embodiment. In comparison therewith, however, this frame comprises a high rigidity without the need of specific additional measures because no lateral slots are present therein. Means for a mounting to the main machine frame are located at the side of the frame 2 such as is the case in all other embodiments, which means in this case specifically are screw holes 13.

In order to exchange the card clothing the corresponding supporting member 3 is screwed off the frame. Thereafter, the clips 5 at the dismounted supporting member 3 can be opened. The location or orientation, respectively, of the card clothing relative to the main drum 6 can be determined by correspondingly dimensioning the supporting members 3. In comparison with the embodiment illustrated in FIGS. 3 and 4 this embodiment has, however, the drawback of a tolerance addition of the dimensional tolerances of the supporting members 3 and their contact surfaces.

Figure 7:
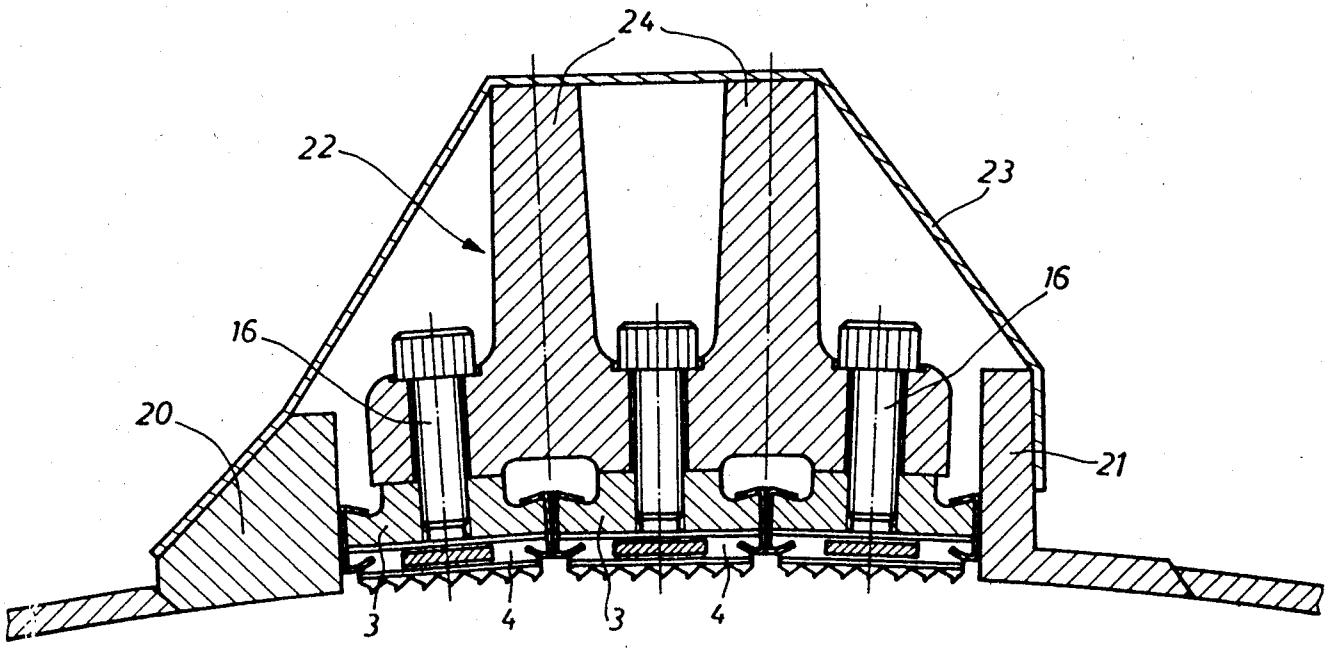
FIG. 7 is a further embodiment of a card flats segment constructed in accordance with the present invention.

Finally, a further embodiment will now be described in conjunction with the illustration of FIG. 7 which is designed roughly on a true scale. Here the frame 2 is shaped of a plurality of supporting profiles extending across the entire width of the carding machine, namely, the frame profiles proper 20, 21 and a supporting profile 22 for the supporting members 3. The supporting profile 22 is an integral piece and consists of a cast article made of a metal alloy, preferably of an aluminium alloy. It may be also manufactured as extruded, drawn profile article. The shape of the supporting members 3 corresponds roughly to the shape of the supporting members illustrated in FIG. 5 and they are mounted similarly releasable and adjustable by means of screw bolts 16 to the supporting profile 22 such that the card clothing 4 can be exchanged following the procedure described with reference to FIG. 5. The embodiment according to FIG. 7 leads to a dimensionally exact segment which is quite resistant to bending because the carrying profile being a cast article can be provided with bracing ribs 24 and manufactured to extremely close tolerances. A covering hood 23 prevents the egress of dust between the openings prevailing between the individual frame profiles and suppporting profile.

In all embodiments the number of supporting members arranged in one given frame 2 can amount generally to between 2 and 4. The upper limit is based on weight considerations because the card flats segments 1 should be preferably of such a weight that they can be lifted off manually. Preferably, the inventive card flats segments 1 are located at the inflow area above the taker-in or the exit area over the doffer. In the first case due to space considerations frames having two to three supporting members and in the second case such including three to four supporting members are preferred.

The card flats segments according to the invention can be applied by combining a plurality of individual segments as single carding element. Preferably, however, they are applied together with revolving flats, in which case the operating sector thereof may possibly be reduced (from about 60° to 30°). Furthermore, the card flats segments can be combined with pairs of worker rollers. If applied together with movable carding elements the segments of the present invention will have preferably the function of parallelizing the fibres, in which case the movable elements operate as cleaning members. Thereby, the structure of the card clothing of the individual supporting members 3 can be chosen to differ between the individual supporting members, for instance, such in that the fineness thereof increases gradually from the inlet side to the outlet side. This allows an optimizing of the parallelizing operation of the card flats segment.

It is proven that the card flats segment constructed in accordance with the invention is superior to the known revolving flat cards with regard to its manufacture and maintenance as well as to its operation in combination or depending on the material to be handled (synthetical fibres) also without the use of revolving flats.

While there are shown and described present preferred embodiments of the invention, it is to be distinctly understood that the invention is not limited thereto, but may be otherwise variously embodied and practiced within the scope of the following claims.

We claim:

1. A card flats segment intended for a rigid mounting to a carding machine, comprising a plurality of supporting members integrated in a frame, which supporting members are arranged directly adjacently succeeding each other in the direction of the carding and extend at least across the width of the card, each supporting member being designed for a releasable receipt of sawtooth card clothing wires forming the card clothing and lined up thereupon across mentioned width of the card, each individual supporting member being arranged to be independently adjustable regarding distance and angle of pitch relative to the circumference of the main drum.

2. The card flats segment of claim 1, in which each supporting member is formed by a revolving flat, which flats are releasably mounted at their outside to longitudinal struts of the frame.

3. The card flats segment of claim 1, in which the supporting members are formed as an integral part of the frame and are defined by slots extending across the width of the card, which slots are intended for receipt of mountings for the releasable mounting of the card clothing to the respective flat and are accessible from the card flats segment upper side.

4. The card flats segment of claim 3, in which the surfaces of the supporting members which face the main drum of the carding machine are designed for a true to site positioning of the card clothing relative to the main drum.

5. The card flats segment of claim 1, in which the frame has a carding flat shaped configuration and comprises at its lower side a surface intended for receipt of releasably thereto mounted supporting members of a strip-like configuration.

6. The card flats segment of claim 1, in which the frame or at least the portions thereof extending across the width of the card are formed as extruded aluminium profiles.

7. The card flats segment of claim 1, in which the supporting members are designed to receive card clothing wires used in revolving flats and which are releasably mounted thereto by means of clamps.

8. The card flats segment of claim 1, in which the supporting members are designed for receipt of card clothing wires having characteristics which vary between individual supporting members.

9. The card flats segment of claim 1, in which the frame is provided with means allowing a releasable mounting thereof to the main frame of the carding machine.

10. The card flats segment of claim 1, in which the card clothing or the lower surface of the supporting members respectively, has a flat shape.

11. The card flats segment of claim 1, in which the card clothing extends in the carding direction substantially across the entire extent of the supporting members.

* * * * *